United States Patent [19]

Ellis et al.

[11] Patent Number: 4,676,259

[45] Date of Patent: Jun. 30, 1987

[54] NICOTINE ENHANCED SMOKING DEVICE

[75] Inventors: Michael P. Ellis; Jon P. Ray, both of San Antonio, Tex.

[73] Assignee: Advanced Tobacco Products Inc., San Antonio, Tex.

[21] Appl. No.: 714,696

[22] Filed: Mar. 21, 1985

[51] Int. Cl.[4] ..... A24D 3/14

[52] U.S. Cl. ..... 131/335; 131/337

[58] Field of Search ..... 131/335, 337, 332

[56] References Cited

U.S. PATENT DOCUMENTS

| | | | |
|---|---|---|---|
| 2,860,638 | 11/1958 | Bartolomeo | 128/201 |
| 3,109,436 | 11/1963 | Bavley et al. | 131/17 |
| 3,280,823 | 10/1966 | Bavley et al. | 131/10 |
| 3,422,819 | 1/1969 | Jones et al. | 131/335 |
| 3,584,630 | 6/1971 | Inskeep | 131/9 |
| 3,603,319 | 9/1971 | Badgett | 131/10.9 |
| 3,861,400 | 1/1975 | Perkins et al. | 131/335 |
| 4,195,645 | 4/1980 | Bradley, Jr. et al. | 131/337 |
| 4,284,089 | 8/1981 | Ray | 131/270 |
| 4,318,417 | 3/1982 | Hiroshi et al. | 131/274 |
| 4,340,072 | 7/1982 | Bolt et al. | 131/273 |
| 4,350,173 | 9/1982 | Siren | 131/332 |
| 4,474,191 | 10/1984 | Steiner | 131/198 A |

FOREIGN PATENT DOCUMENTS

| | | | |
|---|---|---|---|
| 2015961 | 9/1979 | United Kingdom | 131/337 |

*Primary Examiner*—V. Millin
*Assistant Examiner*—H. Macey
*Attorney, Agent, or Firm*—Arnold, White & Durkee

[57] ABSTRACT

A nicotine-enhanced smoking article having a first tobacco portion and a second filter portion attached thereto. The filter portion containing filter fibers and a nicotine solution having 5–15%, by weight of total solution, nicotine or a nicotine salt in a solvent. The interaction of the combination products from the first portion with the nicotine solution results in the absorption by the combustion products of nicotine from the solution providing increased nicotine to the user.

7 Claims, No Drawings

NICOTINE ENHANCED SMOKING DEVICE

BACKGROUND OF THE INVENTION

The present invention relates to a nicotine-enhanced smoking device such as a combustible cigarette. The invention also relates to a combustible cigarette enhanced with a nicotine solution which efficiently delivers increased nicotine to the smoker. The invention further relates to a nicotine-enhanced combustible cigarette which delivers increased nicotine to the user without substantially increasing the amount of tar or other combustion products.

Tobacco has been used for hundred of years by many cultures throughout the world. Presently, the most popular method is smoking in the form of a cigarette. However, smoking cigarettes is associated with inherent health hazards. Cigarettes low in both tar and nicotine are the result of recent efforts to provide a safer cigarette.

Medical research has established that nicotine is the active ingredient in tobacco. Small doses of nicotine provide the user with certain pleasurable effects resulting in the desire for additional doses. However, recent medical research published by Russell et al, "Nasal Nicotine Solution, A Potential Aid To Giving Up Smoking?", *British Medical Journal,* Volume 286 p. 683 (Feb. 26, 1983), indicates that the nicotine itself is not a carcinogen. There is also evidence that nicotine is not responsible for the high rate of premature death among cigarette smokers, for example, see Wald, N. J. et al., Serum Nicotine Levels in Pipe Smokers; Evidence Against Nicotine As Cause of Coronary Heart Disease, *The Lancet,* Oct. 10, 1981, p. 775. However, one who uses tobacco in the form of conventional cigarettes for the pleasurable effects of nicotine must also risk the dangers of coronary heart disease and cancer that may arise from other components of the smoke which may not contribute to the pleasurable effects that nicotine may produce.

Medical research also indicates that there is no correlation between the blood nicotine levels of smokers and the nicotine yields of their cigarettes. Thus, many smokers who switch to low nicotine brands for health reasons usually end up smoking more cigarettes to maintain the same blood nicotine levels. Russell, Nicotine Intake and its Regulation, *Journal of Psychosomatic Research,* Volume 24, p. 253 (December 1979). Russell also points out that smokers who cannot stop smoking because they are dependent on nicotine are not likely to be able to reduce their nicotine intake by switching to cigarettes which deliver hardly any nicotine. A need therefore exists for a cigarette with a higher nicotine to tar ratio. Such a cigarette would satisfy the desire for nicotine in an individual unable to quit smoking, while reducing potential health risks associated with the inhalation of tar or other smoke components which are not pleasure-enhancing.

Previous attempts to increase the nicotine delivered by a cigarette do not provide for an efficient release of nicotine from the cigarette. For example, U.S. Pat. No. 3,280,823 to Bavley et al. discloses the incorporation of a nicotine-cation exchange resin in a cigarette filter. Example 1 in column 9, reveals that the addition of 6.6 milligrams of nicotine (33% times mg. of resin) results in the release of 0.15 milligrams nicotine, or 2.2% of the nicotine added. Similarly, in Example 2, the nicotine release efficiency is 2.1%. Incorporating the nicotine-cation exchange resin into the tobacco instead of the filter as in U.S. Pat. No. 3,109,436, to Bavley, et al., improves the nicotine release efficiency (2.9% in Example 5 to 9.0% in Example 7), but results in the introduction of ion exchange resin combustion products into the smoke.

U.S. Pat. No. 3,584,630 to Inskeep discloses the addition of carbon black having nicotine adsorbed on its surface to cigarettes. Incorporating the carbon black-adsorbed nicotine into the filter portion of the cigarette results in a nicotine release efficiency ranging from 1.7% in Example 3 to 5.6% in Example 2. Adding the carbon black-adsorbed nicotine to the tobacco portion of the cigarette results in an efficiency of 12.4%, but again, carbon black and nicotine combustion products are introduced into the smoke.

These patents also disclose that it is not feasible to add nicotine per se to tobacco products because of the volatility and chemical instability of nicotine.

Therefore, it is an object of the present invention to provide a nicotine-enhanced smoking device with a high nicotine release efficiency. It is a further object of this invention to provide a nicotine-enhanced smoking device with an improved nicotine to tar ratio. These and other objects of the invention will become apparent from the following summary and description of the preferred embodiments.

SUMMARY OF THE INVENTION

The present invention provides a nicotine-enhanced smoking device with a high nicotine release efficiency. The smoking device also has a high ratio of nicotine to tar in smoke delivered to the smoker.

The term "nicotine release efficiency" is defined for purposes of this disclosure as the increase in nicotine delivered to the smoker attributable to enhancement of the smoking device, expressed as a percentage of nicotine added thereto.

The nicotine-enhanced smoking device of this invention comprises two portions. The first portion is combustible material such as tobacco, encased in a combustible material such as paper. The second portion is attached to the first portion and contains a nicotine solution. During combustion of the first portion, the configuration of the smoking device permits the interaction of combustion products with the nicotine solution contained in the second portion. The interaction of the combustion products from the first portion with the nicotine solution results in the absorption by the combustion products of nicotine from the solution. The combustion products and absorbed nicotine are drawn from the smoking device by the smoker. Thus, the smoker is provided with more nicotine from the nicotine-enhanced device than from a similar smoking device which does not contain the nicotine solution or from a comparable cigarette.

The nicotine solution comprises either nicotine and a solvent which acts as a complexing substance to form a new moiety with the nicotine or nicotine salts and a solvent. The nicotine solution is substantially non-volatile and chemically stable. Thus, no nicotine is delivered to the user until the tobacco is actually ignited. Evaporation and chemical degradation either do not occur or they are insubstantial and the nicotine concentration in the second portion is largely unaffected by length of storage prior to use.

It has also been found that the nicotine from the solution in the second portion is efficiently released into the combustion products from the first portion. A higher percentage of nicotine present in the second portion before ignition is released into the combustion products from the burning material than has been herebefore known.

DETAILED DESCRIPTION OF A PREFERRED EMBODIMENT

The smoking device of the present invention may take the form and appearance of any conventional smoking device such as a cigarette, a cigar or a pipe. The device includes a first portion that is combustible to produce smoke that may be inhaled by the user. The first portion may include any nicotine or non-nicotine bearing material, including tobacco, cocoa or the like which produces a relatively pleasant, inhalable smoke. The first portion also includes a housing that contains the combustible material. The housing is subject to considerable variety, dependent solely on the user's personal tastes and preferences. The housing may be paper like that used in forming cigarettes. In addition, the housing may be dried tobacco leaves, as used with cigars. As still another alternative, the housing could be wood as used with pipes.

The second portion is connected to the first portion so as to be in the line of passage of the smoke produced in the first portion in route to a user's lungs. In conformity with the configuration of the first portion, the second portion may have a variety of configurations. In addition, the second portion may be permanently affixed to or removably secured to the first portion. For example, the second portion may have the appearance of a paper wrapped cigarette and may be bound within the same paper that covers the first portion. Also the second portion may have the tobacco wrapped configuration of a cigar and may be bound within the same tobacco wrapper as the first portion. Alternatively, the second portion may have the configuration of the mouth piece of a pipe threadedly securable to the bowl. Moreover, the second portion may take the form of a removable cartridge that may be held within the mouth piece in a manner that filter cartridges have been removably contained in the past.

In other instances, the second portion may take a broadly tubular configuration with a mouth piece on one end and a enlarged cylindrical end portion on the opposite end. The enlarged cylindrical end portion may frictionally retain an end of the first portion concentrically within, in a detachable manner. The first and second portions are integrally connected and may be fixedly attached or detachably attached as described above.

The first and second portions may be a conventional filter-tipped cigarette having the nicotine solution contained in the filter. Preferably, the conventional cigarette is a low tar cigarette.

The nicotine solution of this invention may be incorporated into the filter by injection after the cigarette is manufactured. Alternatively, the nicotine solution may be coated on the fibers comprising the filter before they are made into filters which are used in cigarette manufacture.

The nicotine in the nicotine solution of this invention is selected from the group consisting of nicotine (d), nicotine (1), nicotine (d1) and nicotine salts. Nicotine is colorless or yellow in color and is characterized by being oily and very hygroscopic. Nicotine turns to the familiar brown color on exposure to light or air.

Nicotine is obtained by extraction from dried tobacco leaves where it occurs to the extent of 2% to 8%, combined with citric, maleic and other acids. The commercial nicotine which is available in the marketplace is entirely a byproduct of the tobacco industry. Extraction and purification procedures are generally well-known in this industry.

In one embodiment of the present invention, nicotine may be complexed with another substance to form a nicotine moiety which is resistant to evaporation and degradation. Materials found to be useful in forming the nicotine moiety include alcohols, esters, hydrocarbons, aldehydes, ketones and ethers. The preferred complexing materials are polysiloxanes, such as polyphenylmethylsiloxane.

In another embodiment of the present invention, the nicotine solution comprises nicotine salts in a solvent. The solvent may be organic, but is preferably aqueous. The nicotine salts are easily obtained by reacting an acid with nicotine. The acid may be organic or inorganic. Inorganic acids are preferred because they result in less tar being delivered to the smoker.

The nicotine solution of this invention may contain 5% to 15% nicotine, by weight of the total solution. The preferred amount is 10%.

EXAMPLE 1

A nicotine solution was prepared by mixing nicotine, obtained from Eastman Chemical, Stock No. 1242, with Polysynlane obtained from Dow Chemical, Stock No. 556, in a 1 to 10 volume ratio of nicotine/Polysynlane. Ten milligrams of the nicotine solution was injected intermediately into the filter of a Kent brand 85 millimeter low tar cigarette. Using standard FTC determinations of tar and nicotine the nicotine-enhanced cigarette delivered an average of 0.48 milligrams nicotine per cigarette and 3.34 milligrams tar per cigarette, compared to the FTC standard of 0.3 milligrams nicotine per cigarette and 2.0 milligrams tar per cigarette. Thus, the nicotine release efficiency was 12.4%. When smoked, the cigarette had the effect of a strong cigarette such as Marlboro brand or Camel brand.

Further modifications of the present invention will be apparent to those skilled in the art who have had the benefit of this disclosure. Such modifications however lie within the spirit and scope of the invention as defined by the following claims.

What is claimed is:

1. A nicotine-enhance smoking device, comprising:
(a) a first portion comprising combustible material and a housing, said material contained in said housing, and
(b) a second portion attached to said first portion, said second portion being characterized by containing filter fibers and a nicotine solution comprising 5–15%, by weight of total solution, nicotine or a nicotine salt in a solvent, the configuration of said first and second portions permitting interaction of combustion products of said first portion with said nicotine solution.

2. A nicotine-enhanced smoking device according to claim 1 wherein said solvent is a polysiloxane.

3. A nicotine-enhanced smoking device according to claim 1 wherein said second portion contains filter fibers having said nicotine solution coated thereon.

4. A nicotine-enhanced smoking device according to claim 4 1 wherein said second portion contains filter fibers having said nicotine solution injected therein.

5. A nicotine-enhanced smoking device according to claim wherein said first and second portions are in the shape of a cigarette.

6. A nicotine-enhanced smoking device according to claim 5 wherein said first and second portions are integrally connected.

7. A nicotine-enhanced smoking device according to claim 5 wherein said first and second portions are detachable.

* * * * *

UNITED STATES PATENT AND TRADEMARK OFFICE

CERTIFICATE OF CORRECTION

PATENT NO. : 4,676,259

DATED : June 30, 1987

INVENTOR(S) : Ellis et al.

It is certified that error appears in the above-identified patent and that said Letters Patent is hereby corrected as shown below:

Claim 1, Column 4, line 49, delete the word "enhance" and insert --enhanced--.

Claim 4, Column 4, line 67, delete the numeral "4" between the word "claim" and the numeral "1".

Claim 5, line 3, Column 5, insert the numeral --1-- between the word "claim" and the word "wherein".

Claim 6, Column 6, line 1, delete the numeral "5" between the word "claim" and the word "wherein" and insert the numeral --1--.

Signed and Sealed this

Eighth Day of December, 1987

*Attest:*

DONALD J. QUIGG

*Attesting Officer*

*Commissioner of Patents and Trademarks*